US011021861B2

(12) United States Patent
Muellenbach et al.

(10) Patent No.: US 11,021,861 B2
(45) Date of Patent: Jun. 1, 2021

(54) TOILET WITH COLLECTION CHAMBER

(71) Applicant: Kohler Co., Kohler, WI (US)

(72) Inventors: Keith E. Muellenbach, Sheboygan, WI (US); Randy O. Mesun, Sheboygan, WI (US); Kyle L. Hokel, Sheboygan Falls, WI (US)

(73) Assignee: Kohler Co., Kohler, WI (US)

( * ) Notice: Subject to any disclaimer, the term of this patent is extended or adjusted under 35 U.S.C. 154(b) by 45 days.

(21) Appl. No.: 16/267,765

(22) Filed: Feb. 5, 2019

(65) Prior Publication Data

US 2019/0242105 A1 Aug. 8, 2019

Related U.S. Application Data

(60) Provisional application No. 62/626,731, filed on Feb. 6, 2018.

(51) Int. Cl.
*E03D 11/02* (2006.01)
*E03D 3/02* (2006.01)
*E03D 11/13* (2006.01)

(52) U.S. Cl.
CPC ..... *E03D 11/02* (2013.01); *E03D 3/02* (2013.01); *E03D 11/13* (2013.01)

(58) Field of Classification Search
CPC ..... E03D 11/02; E03D 11/13; E03D 11/08; E03D 11/06; E03D 3/02; E03D 2201/30; E03D 2201/40; E03D 11/18
USPC ..... 4/420, 425, 348, 421, 423
See application file for complete search history.

(56) References Cited

U.S. PATENT DOCUMENTS 1,391,477 A * 9/1921 Hinsdale ..... E03D 9/05 4/425
1,957,809 A * 5/1934 Schossow ..... E03D 11/08 4/423
2,034,173 A * 3/1936 Brooks ..... E03D 5/026 4/423
2,411,301 A * 11/1946 Stanitz ..... B21D 51/18 228/173.6

(Continued)

FOREIGN PATENT DOCUMENTS

CA 2072677 A1 12/1993
CA 2048556 C 10/1994

(Continued)

*Primary Examiner* — Charles P. Cheyney
(74) *Attorney, Agent, or Firm* — Lempia Summerfield Katz LLC

(57) ABSTRACT

A toilet includes a bowl portion, a rim portion, and a reservoir. The bowl portion defines a bowl cavity that is in fluid connection with a trapway. The bowl cavity is configured to hold a volume of water to provide a water seal for the trapway. The rim portion extends about an upper portion of the bowl portion. The rim portion defines an internal rim cavity that extends about an upper portion of the rim portion and a plurality of apertures that extend from the internal rim cavity and through a sidewall of the rim portion to direct water from the internal rim cavity to the bowl cavity. The reservoir is in fluid communication with the internal rim cavity and the bowl cavity and configured to receive a supply of pressurized water from a water source and direct at least a portion of the pressurized water to the internal rim cavity.

20 Claims, 4 Drawing Sheets

(56) References Cited

U.S. PATENT DOCUMENTS

| | | | | | |
|---|---|---|---|---|---|
| 3,044,076 | A * | 7/1962 | Martini | E03D 9/08 | 4/420.4 |
| 3,212,106 | A * | 10/1965 | Noel | E03D 11/02 | 4/421 |
| 4,835,797 | A | 6/1989 | Castelli | | |
| 5,142,712 | A | 9/1992 | Hennessy | | |
| 5,515,556 | A | 5/1996 | Johnson | | |
| 5,832,546 | A | 11/1998 | Inch | | |
| 5,918,325 | A * | 7/1999 | Arita | E03D 11/02 | 4/420 |
| 6,145,138 | A * | 11/2000 | Nakamura | E03D 11/02 | 4/420 |
| 6,675,399 | B1 * | 1/2004 | Tomita | E03D 3/00 | 4/420.2 |
| 6,986,172 | B2 | 1/2006 | Hidetaka | | |
| 2018/0171615 | A1 * | 6/2018 | Liu | E03D 11/025 | |

FOREIGN PATENT DOCUMENTS

| | | | |
|---|---|---|---|
| CA | 2220586 | C | 10/2006 |
| CN | 1432094 | A | 7/2003 |
| CN | 1295405 | C | 1/2007 |
| KR | 20030023616 | A | 3/2003 |
| KR | 100745597 | B1 | 8/2007 |
| WO | WO 2001/073229 | A1 | 10/2001 |

* cited by examiner

TOILET WITH COLLECTION CHAMBER

CROSS-REFERENCE TO RELATED PATENT APPLICATION

The present application claims the benefit of and priority to U.S. Provisional Patent Application No. 62/626,731, filed Feb. 6, 2018, the entire disclosure of which is incorporated herein by reference.

BACKGROUND

The present application relates generally to a toilet bowl assembly. In particular, the present application relates to a toilet bowl assembly that includes a reservoir and an internal rim cavity in fluid communication with the reservoir.

Generally speaking, a toilet may include a reservoir that provides water to a bowl of the toilet during a flushing operation (e.g., after a user has depressed a handle of the toilet, etc.). The flushing operation is typically initiated after waste or other solids have been deposited in the bowl. A volume of water is typically present in the bowl when the solids are deposited in the bowl. When this volume of water is below a threshold, a water seal depth of the toilet may not be maintained after the toilet is flushed. The water seal depth represents an amount of water in the bowl necessary to prevent gases from downstream components (e.g., gases from sewage pipes, septic tanks, etc.) from flowing upstream into the toilet bowl and into a room within which the toilet is located. A toilet is undesirable if it is unable to maintain the water seal depth after a flushing operation.

SUMMARY

One embodiment of the present disclosure is related to a toilet. The toilet includes a bowl portion, a rim portion, and a reservoir. The bowl portion defines a bowl cavity that is in fluid connection with a trapway. The bowl cavity is configured to hold a volume of water to provide a water seal for the trapway. The rim portion extends about an upper portion of the bowl portion. The rim portion defines an internal rim cavity that extends about an upper portion of the rim portion and a plurality of apertures that extend from the internal rim cavity and through a sidewall of the rim portion to direct water from the internal rim cavity to the bowl cavity. The reservoir is in fluid communication with the internal rim cavity and the bowl cavity and is configured to receive a supply of pressurized water from a water source and direct at least a portion of the pressurized water to the internal rim cavity. The reservoir is configured to receive and store a portion of the pressurized water supplied by the water source during a flush cycle. The reservoir is also configured to release the portion of the pressurized water to the internal rim cavity after the flush cycle, such that the portion of the pressurized water flows to the bowl cavity and facilitates maintaining of the water seal provided by the volume of water in the bowl cavity during the flush cycle and after the flush cycle.

Another embodiment of the present disclosure is related to a toilet. The toilet includes a bowl portion, a rim portion, and a reservoir. The bowl portion defines a bowl cavity. The rim portion defines an internal rim cavity and a plurality of apertures. The rim cavity extends about the bowl cavity. The plurality of apertures each extend from the internal rim cavity and through a sidewall of the rim portion such that the internal rim cavity is in fluid communication with the bowl cavity. The reservoir is in fluid communication with the internal rim cavity and the bowl cavity. The reservoir includes a transfer channel and a collection chamber. The transfer channel is in fluid communication with the internal rim cavity and defined by a first wall and a second wall parallel to the first wall. The first wall and the second wall are separated by a first distance. The collection chamber is contiguous with the transfer channel and in fluid communication with the transfer channel. The collection chamber has a width larger than the first distance.

Yet another embodiment of the present disclosure is related to a toilet. The toilet includes a bowl portion, a rim portion, and a reservoir. The bowl portion includes a bowl cavity. The rim portion extends about an upper portion of the bowl portion. The rim portion includes a hole, an internal rim cavity, and a plurality of apertures. The internal rim cavity extends about the bowl cavity. The internal rim cavity is in fluid communication with the hole. Each of the plurality of apertures provide for fluid communication between the internal rim cavity and the bowl cavity. The reservoir provides for fluid communication between the hole and the internal rim cavity. The reservoir includes a transfer channel and a collection chamber. The transfer channel is defined by a first width. The collection chamber is contiguous with the transfer channel and defined by a second width greater than the first width. The hole is disposed within the collection chamber.

It is to be understood that both the foregoing general description and the following detailed description are exemplary and explanatory only and are not restrictive of the invention as claimed.

DETAILED DESCRIPTION

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

A toilet removes waste deposited therein by flushing water from the toilet. After the waste has been removed from the toilet, the toilet is filled with water such that the toilet is ready to remove additional waste from the toilet. The depth of the water in the toilet is related to the ability of the toilet to prohibit the permeation of gases (e.g., noxious gases, methane, etc.) from downstream septic components through the water and out from the toilet. The depth of the water in the toilet can vary depending on how much waste is removed therefrom. For example, when a relatively large amount of waste is removed from the toilet the depth of the water in the toilet thereafter may be less than the depth of the water after a relatively small amount of waste is removed from the toilet. In some instances, where a relatively large amount of waste is removed from the toilet, the depth of the water in the toilet may be insufficient to prohibit the permeation of gases through the water.

Various embodiments herein relate to a toilet that is capable of ensuring that the depth of water in the toilet is always sufficient to prohibit the permeation of gases through the water, even when relatively large amounts of waste are removed from the toilet. The present disclosure describes a toilet with an inlet chamber that fills with water during a flush cycle where waste is removed from a basin of the toilet and releases the water into the basin after the flush cycle such that a depth of water in the basin substantially prohibits the permeation of gases through the water. The inlet chamber collects water during the flush cycle due to the incorporation of a collection chamber in the inlet chamber.

Figure 1:
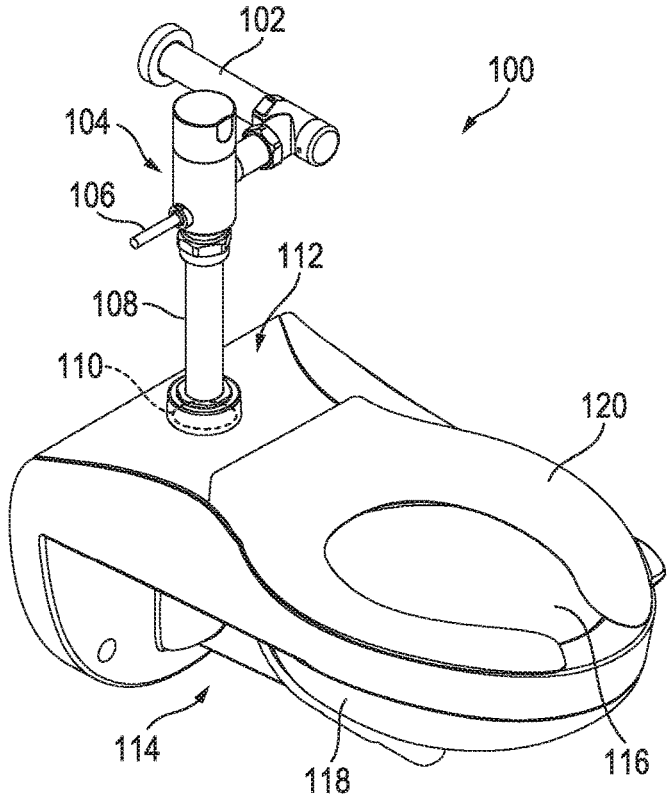
FIG. 1 is a front perspective view of a toilet, according to an exemplary embodiment of the present disclosure.
Figure 2:
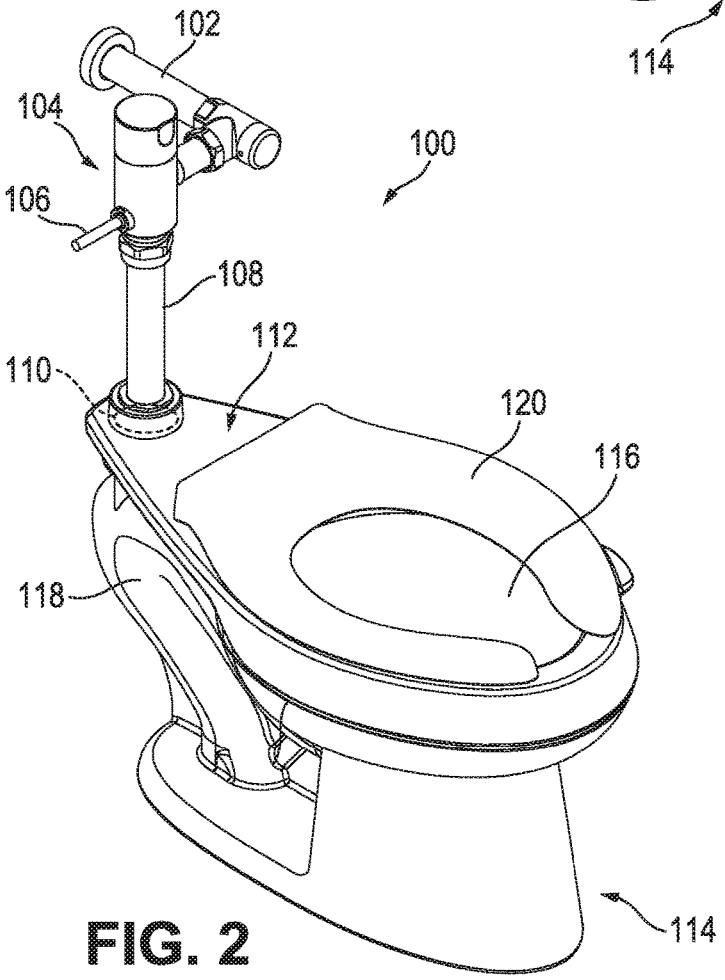
FIG. 2 is a front perspective view of another toilet, according to an exemplary embodiment of the present disclosure.

Referring to FIGS. 1 and 2, a toilet (e.g., commode, etc.), shown as a toilet 100, is shown. In various embodiments, the toilet 100 is a Flushometer toilet. The toilet 100 is configured to selectively perform a flush cycle. The flush cycle is typically initiated after waste or other solids have been deposited in the toilet 100. A volume of water is present in the toilet 100 before the flush cycle has been performed. The toilet 100 operates to ensure that this volume is above a threshold below which a water seal depth may not be maintained. In this way, the toilet 100 is capable of being more desirable than conventional toilets which may be unable to maintain a water seal depth in some situations.

The flush cycle includes a main flush and a refill. During the main flush, water is drained from the toilet 100 (e.g., to remove waste and solids, etc.) by opening a valve. During the refill, water is provided to the toilet 100 while, or after, the water is drained from the toilet 100. The valve is open during the refill and facilitates filling of the toilet 100 with water. Once a target amount of water has been provided to the toilet 100, the valve is closed and the flush cycle is completed. As will be described in more detail herein, a water seal depth of the toilet 100 is maintained after the flush cycle has been completed due to the collection and release of a target amount water from an inlet chamber of the toilet 100.

The toilet 100 is supplied with water by a conduit (e.g., pipe, etc.), shown as a conduit 102. The conduit 102 protrudes from a wall (e.g., surface, etc.) and connects to an assembly (e.g., mechanism, etc.), shown as a valve assembly 104. The valve assembly 104 controls the flow of water from the conduit 102 into the toilet 100, and therefore similarly controls the removal of water from within the toilet 100. The valve assembly 104 includes a handle (e.g., lever, arm, etc.), shown as a handle 106. The handle 106 is movable to cause the valve assembly 104 to initiate the flush cycle.

The toilet 100 also includes a conduit, shown as a conduit 108. The conduit 108 is connected to the valve assembly 104. The conduit 108 is also connected to a hole (e.g., spud hole, aperture, opening, etc.), shown as a hole 110. The hole 110 is located a portion (e.g., rim portion, etc.), shown as a rim 112, of the toilet 100. The rim 112 is coupled (e.g., fastened, adhered, attached, etc.) to a portion (e.g., bowl portion, etc.), shown as a base 114, of the toilet 100. The base 114 supports to the toilet 100 on a ground surface and/or a wall surface. The base 114 defines a basin (e.g., bowl cavity, etc.), shown as a basin 116. The basin 116 also includes a basin outlet (not shown) which is communicable with a trapway, shown as a trapway 118. The basin 116 is configured to selectively hold a volume of water to provide a seal for the trapway 118. The trapway 118 is selectively provides the water from the basin 116 to an outlet of the toilet (not shown) connected to downstream septic components (e.g., septic pipes, septic tanks, etc.).

When the flush cycle is initiated (e.g., when the handle 106 is articulated, etc.), water is drawn from the basin 116 and simultaneously or subsequently provided to the conduit 108. The water that is provided to the conduit 108 is passed into the hole 110, between the rim 112 and the base 114, into the basin 116, out of the basin 116, into the trapway 118, and out of the toilet 100 into downstream septic components. Once a target amount of water has been drawn from the basin 116 (e.g., to allow for the waste and other solids to be expelled from the toilet 100, etc.), water is no longer drained from the basin 116 and instead the water refills the basin 116.

Gases from downstream sewage components can be emitted from a toilet if the depth of the water in a basin of the toilet is less than a water seal depth (e.g., trap seal depth, etc.). The water seal depth is a depth of water that must be present in the basin to substantially prohibit gases from being emitted from the toilet. For example, the water seal depth may be two inches. The water seal depth may be standardized by an agency or organization (e.g., the American Society of Mechanical Engineers, etc.).

Conventional Flushometer toilets may fill a basin such that the depth of water in the basin after a flush cycle is less than the water seal depth, thereby causing gases to escape the toilet. This may occur after, for example, a large amount of waste has been deposited in the toilet. As will be explained in more detail herein, the toilet 100 includes an inlet chamber that collects water during a flush cycle (e.g., during the refill) and releases water into the basin 116 after the flush cycle has been completed (e.g., after the refill) in order to maintain at least a depth of water in the basin 116 that is equal to the water seal depth.

The toilet 100 also includes a seat, shown as a seat 120. In an exemplary embodiment, the seat 120 is coupled to the rim 112. The seat 120 is movable between a first position, where the seat 120 contacts the rim 112, and a second position, where the seat 120 does not contact the rim 112.

In some embodiments, the valve assembly 104 is configured such that the handle 106 may cause the valve assembly 104 to initiate multiple different flush cycles (e.g., a flush cycle for liquid waste, a flush cycle for solid waste, etc.). In addition to, or in place of, the handle 106, the valve assembly 104 may incorporate a sensor (e.g., motion sensor, light sensor, occupancy sensor, etc.) configured to selectively cause the valve assembly 104 to initiate a flush cycle.

Figure 3:
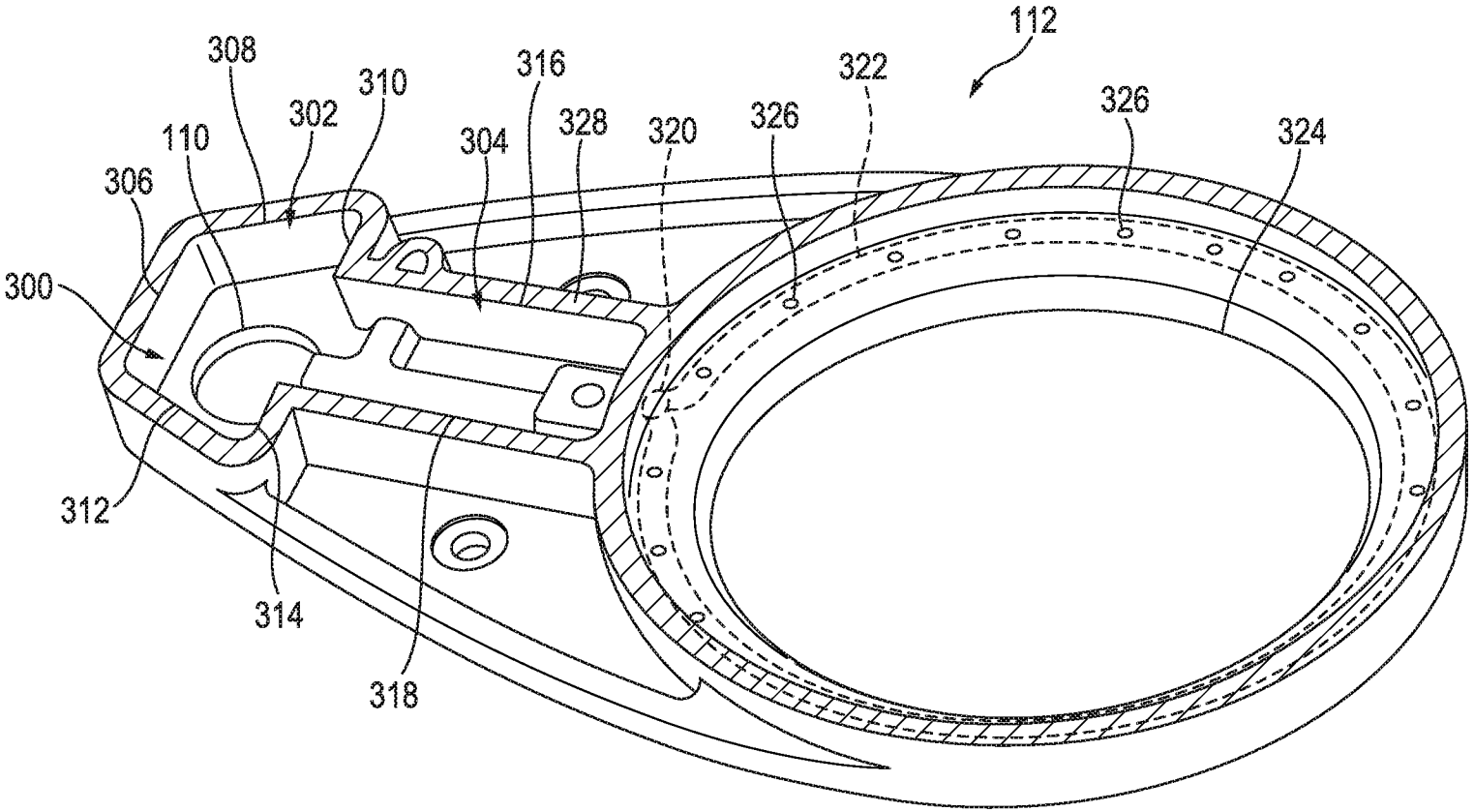
FIG. 3 is a bottom perspective view of a portion of a rim assembly for a toilet, according to an exemplary embodiment of the present disclosure.
Figure 4:
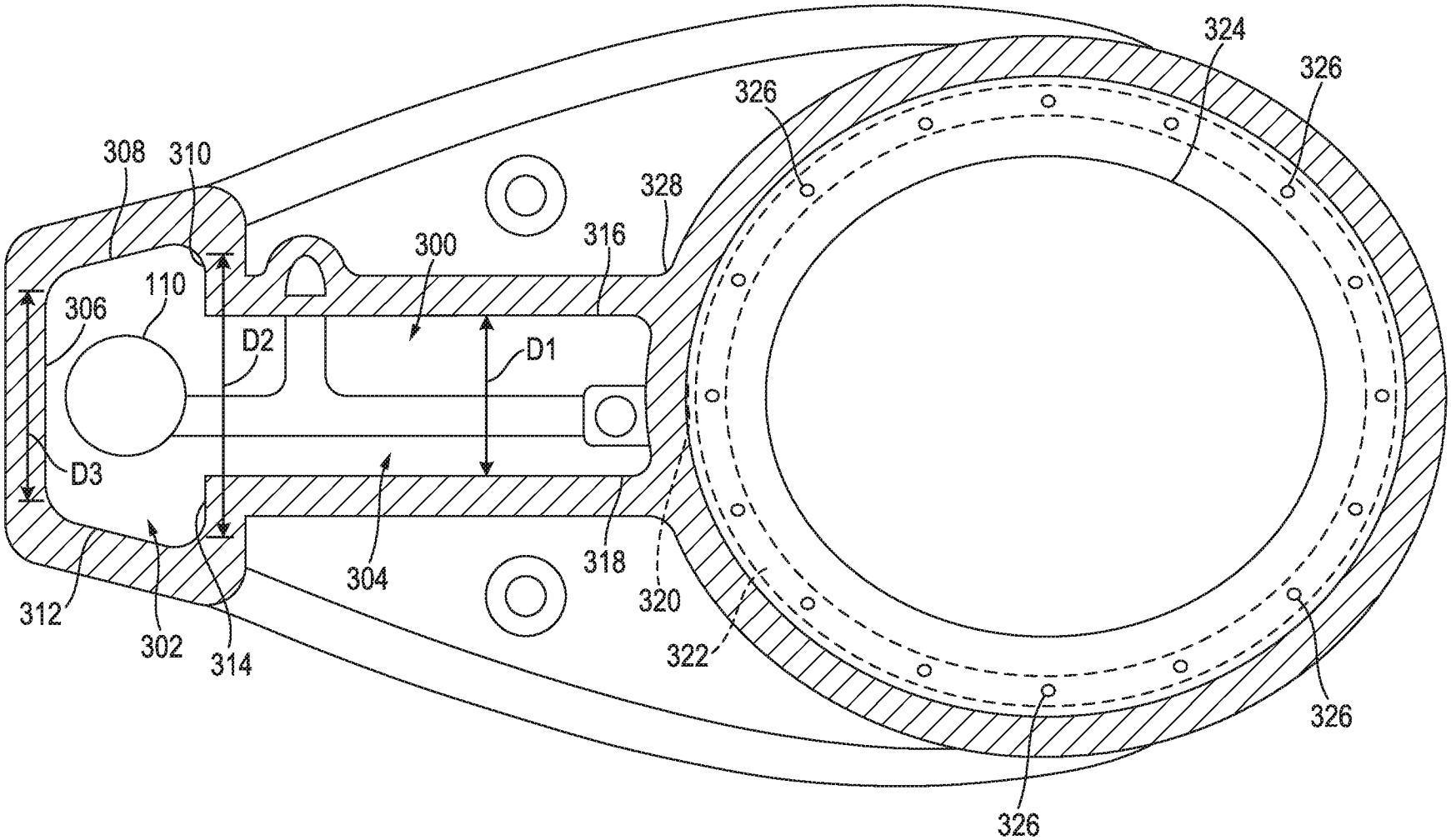
FIG. 4 is a bottom view of the rim assembly shown in FIG. 3.

FIGS. 3 and 4 illustrate the rim 112 in greater detail using a bottom perspective view of the rim 112 in FIG. 3 and a bottom view of the rim 112 in FIG. 4. After the water enters the hole 110 from the conduit 108, the water enters a reservoir, shown as an inlet chamber 300. In addition to functioning to pass water from the conduit 108 to the basin 116, the inlet chamber 300 collects water during a flush cycle such that after the flushing cycle (e.g., after the refill) has been completed, collected water is drained (e.g., completely drained, drained such that no water remains in the inlet chamber 300, etc.), due to the force of gravity on the water, from the inlet chamber 300 into the basin 116 such that the depth of water in the basin 116 is at least equal to the water seal depth of the toilet 100. In this way, the inlet chamber 300 facilitates desirable operation of the toilet regardless of the amount of waste and/or solids removed from the toilet 100 during a flush cycle (e.g., during the main flush).

The inlet chamber 300 is oversized and includes geometric features configured to facilitate collection of water during the flush cycle. Specifically, the inlet chamber 300 includes a first portion, shown as a collection chamber 302 (e.g., accumulator chamber, water accumulator chamber, etc.), and a second portion, shown as a transfer channel 304, which is contiguous with the collection chamber 302. The hole 110 is positioned such that water from the conduit 108 flows into the inlet chamber 300 through the collection chamber 302.

The collection chamber 302 is generally trapezoidal in shape and includes a first wall (e.g., face, surface, boundary, border, etc.), shown as a first wall 306, a second wall, shown as a second wall 308, and a third wall, shown as a third wall 310. The second wall 308 is contiguous with the first wall 306 and the third wall 310. The collection chamber 302 also includes a fourth wall, shown as a fourth wall 312, and a fifth wall, shown as a fifth wall 314. The fourth wall 312 is contiguous with the first wall 306 and the fifth wall 314. The first wall 306 is generally parallel to the third wall 310 and the fifth wall 314. In this way, the second wall 308 and the fourth wall 312 taper from the third wall 310 and the fifth wall 314, respectively, to the first wall 306. An aperture between an endpoint of the third wall 310 and an endpoint of the fifth wall 314 facilitates communication between the collection chamber 302 and the transfer channel 304.

Water from the hole 110 collects in the collection chamber 302 due to the trapezoidal shape of the collection chamber 302 and because the third wall 310 and the fifth wall 314 each extend from the transfer channel 304. Specifically, this shape causes water to be forced into a pocket formed between the second wall 308 and the third wall 310 and into a pocket formed between the fourth wall 312 and the fifth wall 314.

Conventional Flushometer toilets do not have inlet chambers with structures similar to the collection chamber 302. Instead, conventional toilets have straight and rectangular inlet chambers. These inlet chambers do not function to collect water during the flush cycle for the purpose of providing the water after the flush cycle has been completed in order to maintain a depth of water in the toilet that is equal to the water seal depth. In some applications, the collection chamber 302 may provide the inlet chamber 300 with, for example, 5%, 10%, 15%, 20%, 25%, or more additional volume than convention straight and rectangular inlet chambers.

The transfer channel 304 is generally rectangular and includes a first wall, shown as a first wall 316, and a second wall, shown as a second wall 318. The first wall 316 is generally parallel to the second wall 318. The first wall 316 is contiguous with the third wall 310 and the second wall 318 is contiguous with the fifth wall 314.

As shown in FIG. 4, a distance, $D_1$, is defined between the first wall 316 and the second wall 318, a distance, $D_2$, is defined between an apex of the second wall 308 and the third wall 310 and an apex of the fourth wall 312 and the fifth wall 314, and a distance, $D_3$, is defined between an endpoint of the second wall 308 and an endpoint of the fourth wall 312. $D_1$ is less than $D_2$. In various embodiments, $D_1$ is less than $D_3$. However, in some applications, $D_1$ may be greater than $D_3$. In many embodiments, $D_3$ is less than $D_2$. However, in other embodiments, $D_3$ is greater than $D_2$.

The inlet chamber 300 defines a target amount of water that is collected in the inlet chamber 300 during a flush cycle. For example, the inlet chamber 300 may collect 0.01 gallons of water, 0.1 gallons of water, 0.25 gallons of water, 0.5 gallons of water, and other similar amounts. The configuration of the inlet chamber 300 establishes the target amount of water that is collected in the inlet chamber 300 during the flush cycle. For example, the volume of the collection chamber 302, the length of the third wall 310, the length of the fifth wall 314, the angle between the second wall 308 and the third wall 310, the angle between the fourth wall 312 and the fifth wall 314, and other similar characteristics of the inlet chamber 300 can be altered to configure the inlet chamber 300 to collect the target amount of water during the flush cycle. The target amount of water may be based on characteristics of the toilet 100 such as, for example, a gallon per flush (GPF) rating of the toilet 100, a capacity of the basin 116 and other similar characteristics.

In an exemplary embodiment, the third wall 310 and the fifth wall 314 each extend substantially perpendicularly from the first wall 316 and the second wall 318, respectively. In other embodiments, the third wall 310 and the fifth wall 314 do not extend perpendicularly from the first wall 316 and the second wall 318, respectively, and are not parallel with the first wall 306. Instead, the third wall 310 extends at an angle (e.g., forty-five degrees, thirty degrees, sixty degrees, etc.) relative to the first wall 316 and the fifth wall 314 extends at an angle relative to the second wall 318.

The transfer channel 304 contains an opening, shown as an opening 320, that provides the water from the inlet chamber 300 to a channel (e.g., internal rim cavity, passageway, runner, etc.), shown as a channel 322. The channel 322 is in fluid communication with the inlet chamber 300 and is positioned within the rim 112. The channel 322 is circular, oval, or similarly shaped, and circumscribes an opening, shown as an opening 324, in the rim 112. The rim 112 is aligned with the base 114 such that the opening 324 is substantially contiguous with, or adjacent to, the basin 116.

The channel 322 is not intended to substantially store water (e.g., for using in a flush cycle, etc.). Instead, the channel 322 functions as a conduit between the inlet chamber 300, where water is stored, and the basin 116. In this way, the rim 112 is capable of having a slim and sleek profile proximate the opening 324, rather than a bulky and large profile as would be required if water was stored in the channel 322.

The rim 112 also includes a plurality of openings (e.g., jet holes, etc.), shown as holes 326, circumscribing the opening 324 and each being communicable with the channel 322. Water is provided from the collection chamber 302 to the transfer channel 304, through the opening 320, into the channel 322, and out of the holes 326. The water is then propelled from the holes 326 onto and/or into the basin 116 to flush the waste and/or other solids from the toilet 100 and to refill the basin 116 to maintain the water seal depth.

The rim 112 also includes a surface, shown as a bottom surface 328. The bottom surface 328 extends along the rim 112 and is disposed along a single plane such that the rim 112 may be mounted flush against the base 114 and no water may leak between the base 114 and the rim 112. The bottom surface 328 is contiguous with the first wall 306, the second wall 308, the third wall 310, the fourth wall 312, the fifth wall 314, the first wall 316, and the second wall 318. In some embodiments, a gasket, seal, or sealant is incorporated between the rim 112 and the base 114.

Figure 5:
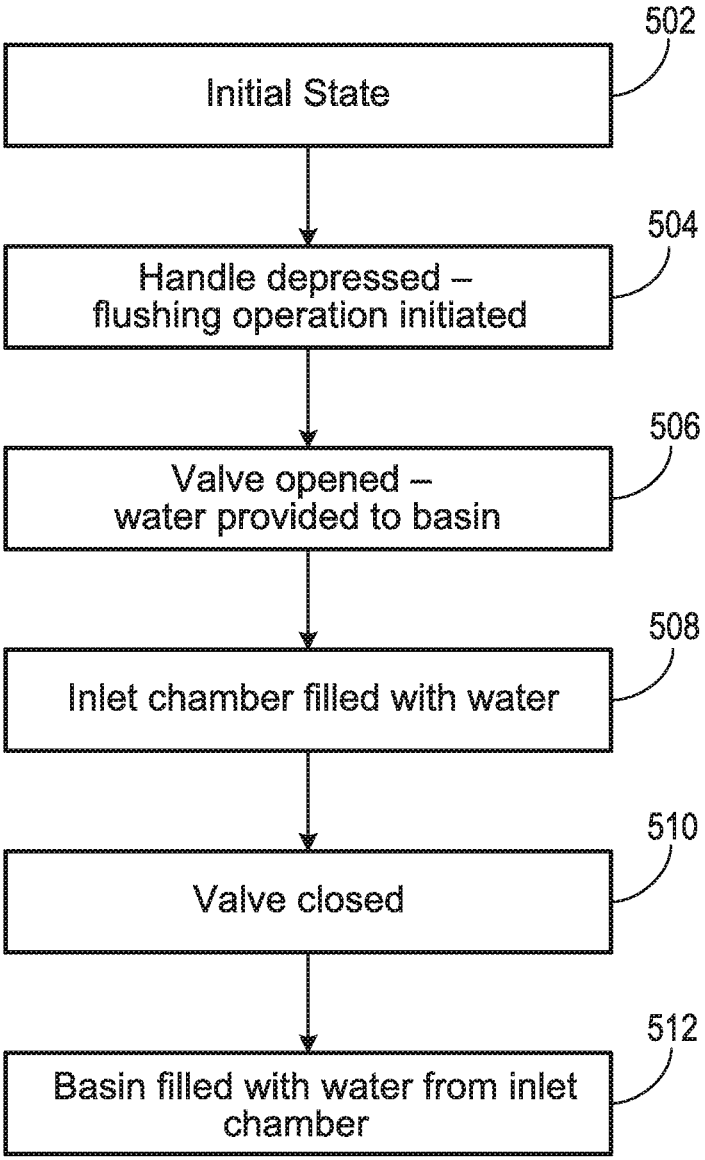
FIG. 5 is a flow chart for a process of using a toilet, according to an exemplary embodiment of the present disclosure.

FIG. 5 illustrates a process, shown as a process 500, for using the toilet 100. Before the process begins (block 502), the toilet 100 is in the initial state. For example, the toilet 100 may be initial state before the handle 106 has been actuated (e.g., before waste has been deposited into the toilet 100, etc.). Once the handle 106 has been depressed (block 504), the flush cycle is initiated. For example, a user may articulate the handle 106 after waste has been deposited into the toilet 100.

The valve of the valve assembly 104 is then opened (block 506), causing water to be provided to the basin 116 while water is simultaneously drained from the basin 116. After the flush cycle has been initiated, any waste deposited in the toilet 100 may be carried out of the basin 116 along with the water. As the water is provided to the basin 116, the inlet chamber 300 is filled with a target amount of water (block 508). For example, the water may collect in the collection chamber 302 as the water flows through the inlet chamber 300.

After a target amount of water has been drained from the basin 116, the valve of the valve assembly 104 is closed (block 510), thereby causing water to cease being drained from the basin 116, and the flush cycle is complete. Unlike conventional toilets, the toilet 100 provides additional water to the basin 116 after the flush cycle has been completed. After the flush cycle has been completed, a target amount water drains from the collection chamber 302 into the basin 116 (block 512) after the valve of the valve assembly 104 is closed. The target amount of water ensures that a depth of water in the basin 116 is at least equal to the water seal depth. After the water has been provided from the inlet chamber 300 to the basin 116, the inlet chamber 300 is substantially empty until another flush cycle is initiated and more water is provided to the inlet chamber 300. The inlet chamber 300 is not filled with water prior to the initiation of a flush cycle, as is done with reservoirs of some toilets.

As utilized herein, the terms "approximately," "about," "parallel," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims. It is understood that the term "parallel" is intended to encompass de minimus variations as would be understood to be within the scope of the disclosure by those of ordinary skill in the art.

Additionally, the word "exemplary" is used to mean serving as an example, instance, or illustration. Any embodiment or design described herein as "exemplary" is not necessarily to be construed as preferred or advantageous over other embodiments or designs (and such term is not intended to connote that such embodiments are necessarily extraordinary or superlative examples). Rather, use of the word "exemplary" is intended to present concepts in a concrete manner. Accordingly, all such modifications are intended to be included within the scope of the present disclosure. Other substitutions, modifications, changes, and omissions may be made in the design, operating conditions, and arrangement of the preferred and other exemplary embodiments without departing from the scope of the appended claims.

The terms "coupled," "connected," and the like, as used herein, mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments and that such variations are intended to be encompassed by the present disclosure.

The construction and arrangement of the elements of the toilet 100, the inlet chamber 300, the collection chamber 302, and all other elements and assemblies as shown in the exemplary embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements, the position of elements may be reversed or otherwise varied, and the nature or number of discrete elements or positions may be altered or varied.

Other substitutions, modifications, changes, and omissions may also be made in the design, operating conditions, and arrangement of the various exemplary embodiments without departing from the scope of the present invention. For example, any element disclosed in one embodiment may be incorporated or utilized with any other embodiment disclosed herein. Also, for example, the order or sequence of any process or method steps may be varied or re-sequenced according to alternative embodiments. Any means-plus-function clause is intended to cover the structures described herein as performing the recited function and not only structural equivalents but also equivalent structures. Other substitutions, modifications, changes, and omissions may be made in the design, operating configuration, and arrangement of the preferred and other exemplary embodiments without departing from the scope of the appended claims.

What is claimed is:

1. A toilet comprising:

a bowl portion defining a bowl cavity in fluid connection with a trapway, the bowl cavity configured to hold a volume of water to provide a water seal for the trapway;

a rim portion extending about an upper portion of the bowl portion, the rim portion defining an internal rim cavity extending about an upper portion of the rim portion and a plurality of apertures extending from the internal rim cavity and through a sidewall of the rim portion to direct water from the internal rim cavity to the bowl cavity; and a reservoir in fluid communication with the internal rim cavity and the bowl cavity and configured to receive a supply of pressurized water from a water source and direct at least a portion of the pressurized water to the internal rim cavity;

wherein the reservoir is configured to receive and store a portion of the pressurized water supplied by the water source during a flush cycle, and to release the portion of the pressurized water to the internal rim cavity after the flush cycle is completed, such that the portion of the pressurized water flows to the bowl cavity and facilitates maintaining of the water seal provided by the volume of water in the bowl cavity during the flush cycle and after the flush cycle.

2. The toilet of claim 1, wherein the reservoir comprises:

a transfer channel configured to provide water to the internal rim cavity, the transfer channel defined by a first wall and a second wall parallel to the first wall, the first wall and the second wall separated by a first distance; and a collection chamber contiguous with the transfer channel, the collection chamber configured to receive water and to provide water to the transfer channel, the collection chamber having a width larger than the first distance.

3. The toilet of claim 2, wherein the collection chamber is trapezoidal in shape and is defined by:

a third wall contiguous with the first wall;

a fourth wall contiguous with the second wall;

a fifth wall contiguous with the third wall;

a sixth wall contiguous with the fifth wall; and a seventh wall contiguous with the fourth wall and the sixth wall.

4. The toilet of claim 3, wherein the third wall is substantially orthogonal to the first wall and the fourth wall is substantially orthogonal to the second wall.

5. The toilet of claim 3, wherein:

the sixth wall is defined by a first length between a first intersection between the sixth wall and the fifth wall and a second intersection between the sixth wall and the seventh wall; and the first length is equal to the width.

6. The toilet of claim 5, wherein:

the fifth wall is defined by a second length between the first intersection and a third intersection between the fifth wall and the third wall;

the seventh wall is defined by a third length between the second intersection and a fourth intersection between the seventh wall and the fourth wall; and the second length is equal to the third length.

7. The toilet of claim 5, wherein:

the third wall is defined by a second length between a third intersection between the fifth wall and the third wall and a fourth intersection between the third wall and the first wall; and the fourth wall is defined by a third length between a fifth intersection between the seventh wall and the fourth wall and a sixth intersection between the fourth wall and the second wall; and the second length is equal to the third length.

8. The toilet of claim 2, further comprising a conduit configured to provide the water to the reservoir;

wherein the rim portion comprises a hole and the conduit is coupled to the rim portion over the hole; and wherein the hole is positioned over collection chamber such that water from the conduit is provided to the collection chamber before the water is provided to the transfer channel.

9. The toilet of claim 1, wherein, during the flush cycle, the reservoir is configured to store the portion of the pressurized water while simultaneously directing the at least a portion of the pressurized water to the internal rim cavity.

10. The toilet of claim 1, wherein the reservoir is defined between the rim portion and the bowl portion.

11. The toilet of claim 1, wherein the reservoir is configured to be entirely emptied after the flush cycle such that substantially none of the pressurized water is stored in the reservoir prior to a subsequent flush cycle.

12. The toilet of claim 11, wherein the internal rim cavity is configured to be entirely emptied after the flush cycle such that substantially none of the pressurized water is stored in the internal rim cavity prior to the subsequent flush cycle.

13. A toilet comprising:

a bowl portion defining a bowl cavity;

a rim portion defining an internal rim cavity extending about the bowl cavity and a plurality of apertures, each of the plurality of apertures extending from the internal rim cavity and through a sidewall of the rim portion such that the internal rim cavity is in fluid communication with the bowl cavity; and a reservoir in fluid communication with the internal rim cavity and the bowl cavity, the reservoir comprising:

a transfer channel in fluid communication with the internal rim cavity and defined by a first wall and a second wall parallel to the first wall, the first wall and the second wall separated by a first distance; and a collection chamber contiguous with the transfer channel and in fluid communication with the transfer channel, the collection chamber having a width larger than the first distance, wherein the reservoir is configured to receive and store pressurized water supplied during a flush cycle, and to release the pressurized water to the internal rim cavity after the flush cycle is completed, such that the pressurized water flows to the bowl cavity and facilitates maintaining a water seal provided by a volume of water in the bowl cavity during the flush cycle and after the flush cycle.

14. The toilet of claim 13, wherein the collection chamber is trapezoidal in shape and is defined by:

a third wall contiguous with the first wall;

a fourth wall contiguous with the second wall;

a fifth wall contiguous with the third wall;

a sixth wall contiguous with the fifth wall; and a seventh wall contiguous with the fourth wall and the sixth wall.

15. The toilet of claim 14, wherein the third wall is substantially orthogonal to the first wall and the fourth wall is substantially orthogonal to the second wall.

16. The toilet of claim 15, wherein:

the sixth wall is defined by a first length between a first intersection between the sixth wall and the fifth wall and a second intersection between the sixth wall and the seventh wall; and the first length is equal to the width.

17. The toilet of claim 16, wherein:

the fifth wall is defined by a second length between the first intersection and a third intersection between the fifth wall and the third wall;

the seventh wall is defined by a third length between the second intersection and a fourth intersection between the seventh wall and the fourth wall; and the second length is equal to the third length.

18. A toilet comprising:

a bowl portion comprising a bowl cavity;

a rim portion extending about an upper portion of the bowl portion, the rim portion comprising:

a hole;

an internal rim cavity extending about the bowl cavity, the internal rim cavity in fluid communication with the hole;

a plurality of apertures, each of the plurality of apertures providing for fluid communication between the internal rim cavity and the bowl cavity; and a reservoir providing for fluid communication directly between the hole and the internal rim cavity, the reservoir comprising:

a transfer channel defined by a first width; and a collection chamber contiguous with the transfer channel and defined by a second width greater than the first width;

wherein the hole is disposed within the collection chamber, wherein the reservoir is configured to receive and store pressurized water supplied during a flush cycle, and to release the pressurized water to the internal rim cavity after the flush cycle is completed, such that the pressurized water flows to the bowl cavity and facilitates maintaining of a water seal provided by a volume of water in the bowl cavity during the flush cycle and after the flush cycle.

19. The toilet of claim 18, wherein:

the transfer channel is defined by a first wall and a second wall parallel to the first wall, the first wall and the second wall separated by a first distance;

the collection chamber is trapezoidal in shape and is defined by:

a third wall contiguous with the first wall;

a fourth wall contiguous with the second wall;

a fifth wall contiguous with the third wall;

a sixth wall contiguous with the fifth wall; and a seventh wall contiguous with the fourth wall and the sixth wall;

the third wall is substantially orthogonal to the first wall and the fourth wall is substantially orthogonal to the second wall;

the sixth wall is defined by a first length between a first intersection between the sixth wall and the fifth wall and a second intersection between the sixth wall and the seventh wall; and the first length is equal to the second width.

20. The toilet of claim 2, wherein an opening in the transfer channel connects the transfer channel to the internal rim cavity.

* * * * *